US005557176A

United States Patent [19]

O'Brien

[11] Patent Number: 5,557,176

[45] Date of Patent: Sep. 17, 1996

[54] MODULATED ELECTRONIC BALLAST FOR DRIVING GAS DISCHARGE LAMPS

[75] Inventor: Daniel P. O'Brien, Fort Wayne, Ind.

[73] Assignee: Diversitec Incorporated, Fort Wayne, Ind.

[21] Appl. No.: 189,488

[22] Filed: Jan. 31, 1994

[51] Int. Cl.[6] ..... H05B 37/00

[52] U.S. Cl. ..... 315/307; 315/DIG. 4; 315/DIG. 5; 315/DIG. 7; 315/209 R

[58] Field of Search ..... 315/291, 307, 315/DIG. 7, DIG. 5, DIG. 4, 209 R, 224, 244

[56] References Cited

U.S. PATENT DOCUMENTS

| | | | |
|---|---|---|---|
| 3,579,026 | 5/1971 | Paget | 315/209 R |
| 3,593,060 | 7/1971 | Kryder | 315/99 |
| 4,277,726 | 7/1981 | Burke | 315/219 |
| 4,463,286 | 7/1984 | Justice | 315/219 |
| 4,513,226 | 4/1985 | Josephson | 315/219 |
| 4,652,797 | 3/1987 | Nilssen | 315/209 R |
| 4,701,671 | 10/1987 | Stupp et al. | 315/224 |
| 4,862,040 | 8/1989 | Nilssen | 315/244 |
| 4,926,097 | 5/1990 | Taek | 315/307 |
| 5,138,234 | 8/1992 | Moisin | 315/209 R |
| 5,177,408 | 1/1993 | Marques | 315/291 |
| 5,363,020 | 11/1994 | Chen et al. | 315/219 |

OTHER PUBLICATIONS

"Baker Clamps", by Warren Schultz, Motorola Semiconductor Products, Inc. Dated before the invention by applicant.

*Primary Examiner*—Robert J. Pascal
*Assistant Examiner*—Michael Shingleton
*Attorney, Agent, or Firm*—George Pappas

[57] ABSTRACT

A modulated electronic ballast for driving a gas discharge lamp includes a full wave rectifier for supplying a modulating signal to a series fed parallel resonant circuit including two transistors. Inductors are provided on both the hot and neutral alternating current power source lines for shielding the power source from electromagnetic interference and providing transient protection. A biasing circuit supplies a small direct current to the resonant circuit for retaining the resonant circuit in a continuous oscillating mode during substantially zero voltage valleys of the modulating signal. A diode is provided across the base and collectors of each transistor in the resonant circuit for preventing over saturation and co-conduction. A pair of transistors connected together as a Darlington pair and a selectively variable voltage divider network are provided between the full wave bridge and the resonant circuit for selectively varying the voltage of the modulated signal and thereby selectively dimming the discharge lamps.

16 Claims, 2 Drawing Sheets

MODULATED ELECTRONIC BALLAST FOR DRIVING GAS DISCHARGE LAMPS

TECHNICAL FIELD

The present invention relates to the technical field of energizing or driving gas discharge lamps such as fluorescent lamps. More particularly, the present invention relates to improvements to modulated electronic ballast circuits for driving one or a plurality of gas discharge lamps.

BACKGROUND OF THE INVENTION

Gas discharge lamps such as fluorescent lamps are presently commonly used in homes and commercial buildings. The lamps commonly contain a phosphor coated glass tube confining an ionizable gas and a small amount of mercury and include electron-emitting cathodes and electrical terminals at each end. Upon application of proper electrical voltages to the terminals, the gas becomes ionized and an electrical arc is established between the cathodes thereby energizing the phosphor coating which thereby fluoresces generating diffused light. It is known that gas discharge lamps are most efficiently operated when driven with an alternating current of a high frequency typically over 20 Khz.

However, most electrical power sources provide electric current at low frequencies. Alternating current is at 60 Hz in North America and 50 Hz in most other continents. These frequencies have been used in the past and are adequate for driving gas discharge lamps by, for example, stepping up the voltage to an appropriate level for causing the necessary arching for starting the lamp, then limiting the current to the lamp for proper drive levels. To achieve the higher efficiencies that are available by driving the lamps at high frequencies, typically, ballast circuits include a means for creating direct current and thereafter some oscillating or high frequency driver circuit is provided for creating a high frequency signal over 20 KHz. Prior oscillating circuits include series fed parallel resonant or push-pull circuits incorporating two transistors and examples thereof are disclosed in U.S. Pat. Nos. 5,177,408 and 4,277,726. Other such circuits accomplish the high frequency oscillation via integrated components and examples of such oscillating circuits are shown in U.S. Pat. Nos. 5,124,619, 5,178,234, 4,985,664 and 4,717,863. These circuits that first rectify the alternating power source signal to direct current and, thereafter, produce the high frequency lamp driving signal are commonly referred to in the industry as unmodulated ballast driver circuits and are most common in the industry at the present time.

However, there are significant drawbacks and shortcomings associated with the unmodulated lamp driving circuits. For example, component and manufacturing costs associated with the direct current power source and integrated components are generally relatively high thereby sometimes making the unmodulated driver circuit overly costly even though the efficiencies thereof are higher. Typically, in addition to the larger capacitance needed for creating the direct current, an inductance is also then needed for correcting the power factor. Further, numerous supporting components are needed for the direct current producing circuit and the integrated components used for creating the high frequency driving signal.

Modulated lamp driving circuits are also known and, for example, are disclosed in U.S. Pat. No. 3,579,026. Although these circuits solve some of the problems associated with unmodulated lamp driving circuits, they too have shortcomings and drawbacks. The modulated circuits of the past, for example, rectify the alternating power source signal to a substantially unfiltered rectified direct current signal at 120 Hz and, thereafter, modulate a high frequency signal on the 120 Hz signal. Unfortunately, during the zero voltage valleys of the rectified signal, the resonant circuit stops switching and the electric arc across the gas discharge lamp is temporarily discontinued. Unfortunately, this discontinuous mode of operation places added stress on the electrical components since these components are constantly being subjected to "start-up" conditions.

In addition to the discontinuous mode of operation, prior modulated gas discharge lamp driving circuits tend to be inefficient because of inefficient switching of the transistors in the resonant circuit. Typically, these transistors exhibit switching losses due to slow switching times and co-conduction. Although the circuit can normally be designed to prevent such losses during full load conditions, they are not readily capable of operating efficiently during both load and no load conditions and, thus, still exhibit co-conduction and switching losses. Further yet, modulated discharge lamp driving circuits of the past fall short of properly shielding the power source lines from conducted electromagnetic interference (EMI) and also are incapable of dimming the discharge lamps continuously over a large range of light output.

Accordingly, a need exists for a gas discharge lamp driving circuit that solves problems associated with prior such circuits and which further exhibits a high efficiency in terms of lumens output per watt input, has a high power factor, low harmonic distortion, provides sufficient EMI shielding, and which further is relatively inexpensive to manufacture in terms of component costs and manufacturing assembly time.

SUMMARY OF THE INVENTION

It is the principal object of the present invention to overcome the above-discussed disadvantages, shortcomings, and drawbacks associated with prior gas discharge lamp driving circuits.

The present invention overcomes disadvantages associated with prior gas discharge lamp circuits by providing a modulated high frequency gas discharge lamp driving circuit including a full wave rectifier for receiving an alternating power source signal and supplying a substantially unfiltered rectified direct current signal. In the United States, the power source signal would be at 60 Hz and, thus, the rectified direct current signal would be supplied at 120 Hz. An oscillating circuit is coupled to the full wave rectifier and includes a parallel resonant circuit for producing a signal at approximately 30 KHz to 50 KHz (depending on the load) on the rectified direct current signal whenever voltage is supplied thereto. A transformer is also provided and has a primary winding coupled to the oscillating circuit and a secondary winding for driving the discharge lamp(s). The parallel resonant circuit includes two transistors connected in a push/pull relation to the primary winding. A feedback winding is also coupled to the transformer and is connected to the transistor bases for alternatively switching the transistors in response to circuits impedance.

High frequency electromagnetic interference from the oscillating circuit is prevented from traveling to the alternating current power source by incorporating inductors on each of the hot and neutral line conductors that provide alternating current power to the full wave rectifier. These electrically and magnetically independent slug core inductors effectively allow current flow at the lower power source frequency while inhibiting current flow at the oscillating circuit higher frequency i.e., 30 KHz to 50 KHz. Additional EMI filtering is provided with a capacitor between the hot and neutral conductors for shorting out differential high frequency signals. Capacitors are also connected from each of the hot and neutral conductors to ground for shorting out common high frequency signals.

The modulated gas discharge lamp driving circuit operates in a continuous mode by providing a biasing circuit for supplying a small direct current voltage to the oscillating circuit and thereby retaining the transistors in a switching mode during substantially zero current and voltage valleys of the rectified unfiltered direct current signal. The biasing circuit includes a winding coupled to the transformer for producing a lower voltage AC signal which in conjunction with a series connected diode and capacitor create the small direct current voltage. Preferably, a second diode is coupled between the biasing circuit and the oscillating circuit for allowing the small direct current to flow to the oscillating circuit only when the rectified direct current signal voltage is less than the biasing circuit voltage.

Efficient switching is provided and co-conduction is minimized during both load and no load conditions by providing a low instantaneous forward voltage drop diode between the base and collector of each transistor in the resonant circuit. In this fashion, over saturation of the transistors is drastically reduced.

A dimming circuit is provided between the full wave rectifier and the oscillating circuit and accomplishes dimming of the gas discharge lamps by selectively varying the voltage of the rectified direct current signal supplied to the oscillating circuit. The voltage to the oscillating circuit is controlled by a single transistor or two transistors connected together as a Darlington pair. Preferably, a selectively variable voltage divider network is provided and iS connected to the base of the single transistor or one of the Darlington pair transistors thereby effectively varying the voltage of the full wave rectified signal traveling from the full wave rectifier to the oscillating circuit.

In one form thereof, the present invention is directed to a circuit for driving a gas discharge lamp including first and second conductors for connecting to an electrical power source at a first frequency. An oscillating circuit is coupled to the first and second conductors for producing a signal at a second higher frequency than the first frequency on the power source signal and having an output for driving the gas discharge lamp. A first inductor is provided between the first conductor and the oscillating circuit for effectively allowing current flow at the first frequency while inhibiting current flow at the second frequency. A second inductor is also provided between the second conductor and the oscillating circuit for effectively allowing current flow at the first frequency while inhibiting current flow at the second frequency.

In one form thereof, the present invention is directed to a circuit for driving a gas discharge lamp and includes a full wave rectifier for connecting to an alternating power source signal and supplying a substantially unfiltered rectified direct current signal at a first frequency. An oscillating circuit is coupled to the full wave rectifier for producing a signal at a second higher frequency than the first frequency on the rectified direct current signal whenever a voltage is supplied thereto. The oscillating circuit has an output for driving the discharge lamp. A biasing circuit is further provided for supplying a small direct current to the oscillating circuit and for retaining the oscillating circuit in an oscillating mode during substantially zero voltage valleys of the rectified direct current signal.

In one form thereof, the present invention is directed to a circuit for driving a gas discharge lamp and includes a full wave rectifier for connecting to an alternating power source signal and supplying a substantially unfiltered rectified direct current signal at a first frequency. A transformer is provided having a primary winding with first, second, and third tap points with the second tap being intermediate the first and third tap points. The second tap is coupled to the full wave rectifier. The transformer further includes a secondary winding for driving the discharge lamp. A first transistor having its collector connected to the first tap is provided and a second transistor having its collector connected to the third tap is also provided. Each of the transistors have an emitter connected to ground and a base coupled to the full wave rectifier. The transistors oscillate in a push/pull relation when the rectified direct current signal is applied thereto. A diode is connected between the base and the collector of each transistor for directing current from respective base to collector and generally to prevent excessive saturation of the transistors.

In one form thereof, the present invention is directed to a circuit for driving a gas discharge lamp and includes a full wave rectifier for connecting to an alternating power source signal and supplying a substantially unfiltered rectified direct current signal at a first frequency. An oscillating circuit is coupled to the full wave rectifier for producing a signal at a second higher frequency than the first frequency on the rectified direct current signal when the rectified direct current signal is supplied thereto. The oscillating circuit has an output for driving the discharge lamp. A dimming circuit is coupled between the full wave rectifier and the oscillating circuit for selectively varying the voltage of the rectified direct current signal supplied to the oscillating circuit and thereby selectively dimming the discharge lamp.

BRIEF DESCRIPTION OF THE DRAWINGS

The above-mentioned and other features and objects of this invention and the manner of obtaining them will become more apparent and the invention itself will be better understood by reference to the following description of embodiments of the invention taken in conjunction with the accompanying drawings wherein.

Corresponding reference characters indicate corresponding parts throughout the several views of the drawings.

The exemplifications set out herein illustrate preferred embodiments of the invention in one form thereof and such exemplifications are not to be construed as limiting the scope of the disclosure or the scope of the invention in any manner.

DETAILED DESCRIPTION OF SPECIFIC EMBODIMENTS

Figure 1:
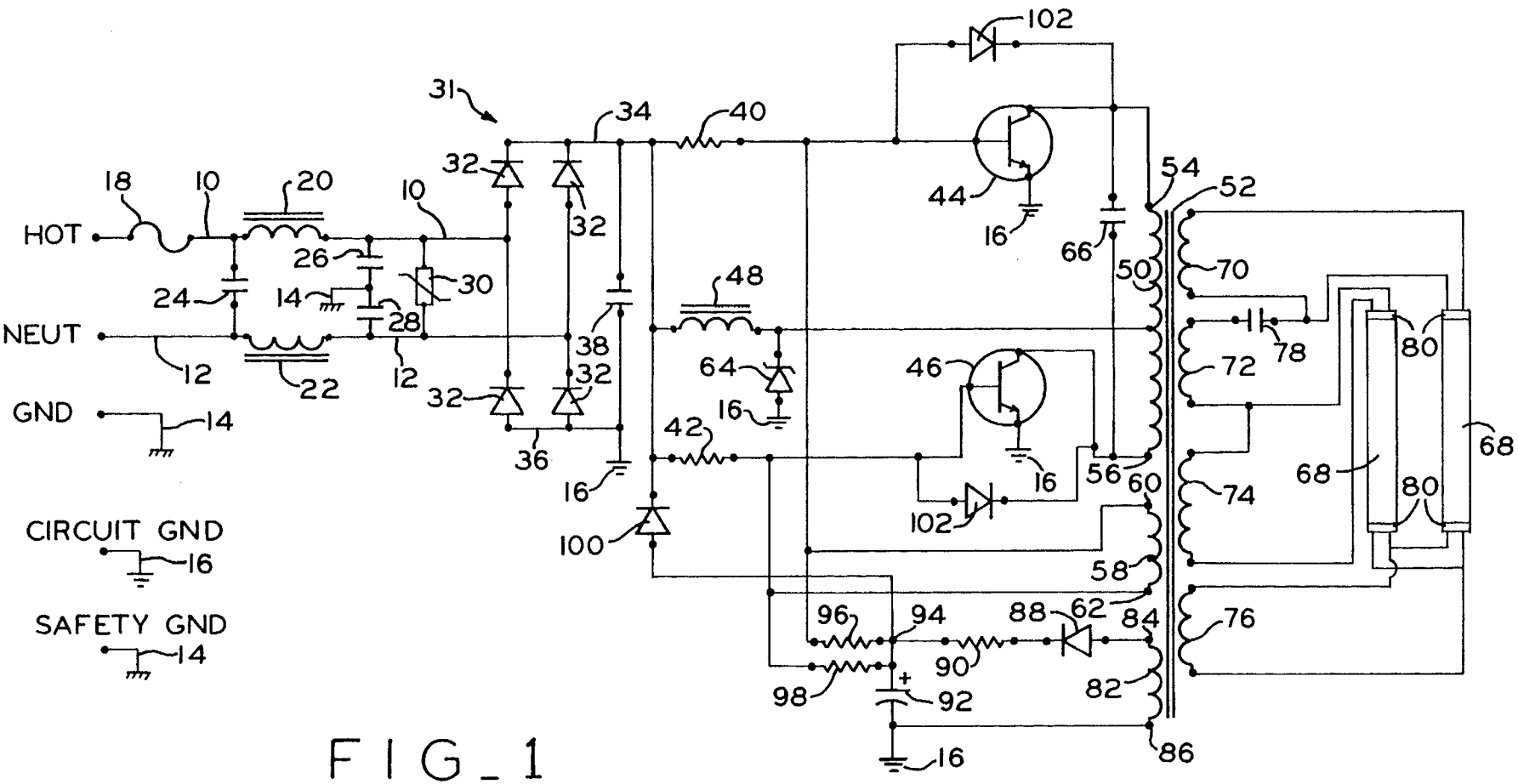
FIG. 1 is a schematic circuit diagram of a circuit for driving a gas discharge lamp according to the present invention; and, FIG. 2 is a schematic circuit diagram of a circuit for driving a gas discharge lamp and showing a dimming circuit incorporated therewith according to the present invention.

Referring initially to FIG. 1, there is shown a schematic diagram of a circuit for driving gas discharge lamps according to the present invention. The circuit includes conductors 10 and 12 adapted for connection to a common alternating current power source in a known and customary manner. The alternating current of the power source in North America will be at 60 Hz. As shown, conductor 10 is adapted for connection to the hot line whereas conductor 12 is adapted for connection to the neutral line. Ground (GND) is also provided to the circuit and for the purposes of this circuit, is the same as safety ground 14. Circuit ground herein is indicated by the numeral 16.

A fuse 18 is provided on the hot line or conductor 10 and is appropriately sized so as to discontinue current flow to the circuit and prevent severe damage thereto in the event of excess current draw. An inductor 20 is provided on conductor 10 and an inductor 22 is provided on conductor 12. Inductors 20 and 22 are electrically and magnetically separated from each other and each has a slug core that is approximately 1.5 inches in length by 0.25 inches in diameter. Inductors 20 and 22 provide an inductance of 4000–5000 μH on respective conductors 10 and 12. Further, inductors 20 and 22 are sized so as to readily and effectively allow current flow through conductors 10 and 12 at the power source frequency of 60 Hz, however, reducing current flow at substantially higher frequencies such as 30 KHz to 50 MHz created by this circuit as more fully discussed hereinbelow. By selection of a soft ferrite core material on the EMI inductors 20 and 22 which exhibit relatively high attenuation of higher frequency content signals, typically greater than 30 MHz, these electrically and magnetically independent inductors provide good cost effective EMI filtering of both common and differential mode noise. Because they are magnetically independent and share no common flux, this set up provides excellent cost effective transient protection from a wide variety transients, both high frequency transient with relatively low energy content and slower moving high energy content transients. Thus, inductors 20 and 22 prevent high frequency EMI from being conducted through conductors 10 and 12 and back to the alternating current power source.

So as to further shield from EMI, capacitor 24 is connected between conductors 10 and 12. Additionally, capacitor 26 is connected between conductor 10 and safety ground and capacitor 28 is connected between conductor 12 and safety ground. Capacitor 24 is sized so that differential mode high frequency signals between conductors 10 and 12 are highly attenuated. Capacitors 26 and 28 are sized for attenuation of common mode high frequency signals between conductors 10 and 12. In the circuit shown in FIG. 1, capacitor 24 is preferably 0.1 μF or larger and capacitors 26 and 28 are 0.0033 μF or smaller so as to effectively not short or cancel the 60 Hz power source signal but to effectively and efficiently cancel differential and common mode noise. Thus, capacitors 24, 26 and 28 provide further EMI filtering in a known and customary manner, to prevent the high frequency signals, here at 30 KHz to 50 MHz, from being conducted back to the alternating current power source in addition to providing transient protection.

Metal oxide varistor 30 is also connected between conductors 10 and 12 and is provided for transient protection. In the circuit as shown, the metal oxide varistor 30 is preferably rated at line voltage and effectively protects against transients such as lightening strikes and large inductive loads such as motors, air conditioners, etc.

Conductors 10 and 12 are connected to and provide alternating current to the full wave bridge rectifier 31 made up of diodes 32. Full wave rectifier 31 provides a rectified unfiltered direct current signal on line 34 and is also connected to line 36 leading to and connected to circuit ground 16 in a known and customary manner. Capacitor 38 is connected across full wave bridge 31 for providing additional EMI filtering. For this purpose, capacitor 38 is preferably 0.015 μF or larger and is intended only to affect high frequency signals. Thus, a modulating signal of 120 Hz which is essentially a substantially unfiltered rectified direct current signal is supplied on line 34. This rectified direct current signal oscillates between approximately zero and 170 volts.

The modulated signal on line 34 is provided through resistors 40 and 42 to respective bases of transistors 44 and 46. The modulated signal of line 34 is also provided through inductor 48 to the center tap of primary winding 50 of transformer 52. One end 54 of primary winding 50 is connected to the collector of transistor 44 whereas the other end 56 of primary winding 50 is connected to the collector of transistor 46. The emitters of both transistors 44 and 46 are connected to circuit ground 16. Thus, transistors 44 and 46 are connected in a push/pull relation to primary winding 50.

A steering or feedback winding 58 is provided on transformer 52 and is, thus, magnetically coupled to the core thereof. Feedback winding 58 at one end 60 is connected to the base of transistor 44 whereas its other end 62 is connected to the base of transistor 46. Feedback winding 58 is wound with respect to primary winding 50 and is connected to the bases of transistors 44 and 46 in a known and customary manner so that when current is flowing through transistor 44, a positive voltage is induced on the base of transistor 44 and a negative voltage is induced on the base of transistor 46 and, further, when a current is traveling through transistor 46, a positive voltage is induced on the base of transistor 46 and a negative voltage is induced on the base of transistor 44. Accordingly, an oscillating or series fed parallel resonant circuit is provided and transistors 44 and 46 are alternatively being switched for alternatively providing current flow in the primary winding between the center tap and respective ends 54 and 56. As can be appreciated, transistors 44 and 46 will continue to alternatively switch or resonate in this fashion as long as voltage is supplied thereto through line 34. It is further noted that the transistors 44 and 46 as well as the other components of this circuit are sized in the manner whereby the high frequency signal created on the primary winding 50 is between 20 KHz to 50 KHz. Preferably, transistors 44 and 46 are of the power bipolar NPN type with well defined characteristics.

Inductor 48 between line 34 and the center tap of primary winding 50 in the present circuit is preferably 4000–5000 μH and has a slug core of 1.25 to 1.5 inches in length and 0.25 to 0.315 inches in diameter. Inductor 48 is provided primarily as a buffer so as to provide efficient switching of transistors 44 and 46 by providing the necessary impedance to prevent the high frequency switching waveform from being imposed on the AC power line. Zener diode 64 is provided and is connected between the center tap of primary winding 50 and circuit ground 16. Zener diode 64 has a breakdown voltage of approximately 300 volts and provides protection to transistors 44 and 46 from being exposed to excessive voltage surges during, for example, lamp arching or rectification modes.

Capacitor 66 is connected across the collectors of transistors 44 and 46 and is used in the L.C resonant mode. In the present circuit, capacitor 66 is preferably 0.0068 μF for aiding in creating the high frequency 20 KHz to 50 KHz sinusoidal signal.

Transformer 52 further includes a secondary winding for driving and causing discharge lamps 68 to fluoresce and produce light. The secondary winding for driving the two gas discharge lamps include windings 70, 72, 74 and 76. Capacitor 78 is connected between windings 70 and 72. Secondary windings 70, 72, 74, and 76 thus provide electric current and a sufficient voltage in the range of 450 Vrms to lamp electrical terminals 80 for starting and continuously driving lamps 68. Capacitor 78 is provided for primarily limiting the current flow to the lamps and, in the preferred embodiment as shown, has a value of 0.0023–0.0056 μF. Lamps 68 will range in characteristic but in large part will be of the gas discharge type.

The gas discharge lamp driving circuit as described hereinabove provides for generally low EMI and low harmonic distortion as well as relatively low costs in components and manufacturing. However, but for the biasing circuit as discussed hereinbelow, the oscillating circuit would operate in a discontinuous mode. That is, during substantially zero voltage valleys of the rectified 120 Hz direct current signal on line 34, transistors 44 and 46 would normally stop switching or oscillating. As can be appreciated, this creates inefficiencies and stress on the components. To prevent these higher stresses and lower efficiencies, the present circuit includes a biasing circuit for supplying a small direct current in the neighborhood of 10 to 15 volts for retaining transistors 44 and 46 oscillating during the substantially zero voltage valleys of the rectified direct current signal. More specifically, a biasing winding 82 is coupled to the core of transformer 52 and has ends 84 and 86. End 86 of winding 82 is connected to ground while end 84 is connected in series to diode 88 of a fast recovery type, 1 Ω resistor 90 and 220 μF capacitor 92 to circuit ground 16. Thus, a small direct current voltage is provided at the connection or node 94 between diode 88 and capacitor 92. This small direct current is supplied through 300–750 Ω resistors 96 and 98 to the bases of respective transistors 44 and 46.

Additionally, the small direct current at connection 94 is supplied to the center tap of primary winding 50 through inductor 48 and diode 100. Diode 100 is of the standard rectifier type and acts to allow current flow only from connection 94 to inductor 48 and the center tap of primary winding 50 and only when the voltage of the modulated signal on line 34 is less than the voltage at connection 94. Thus, at each valley of the rectified direct current signal on line 34, capacitor 92 discharges and provides sufficient current flow to the parallel resonant circuit for transistors 44 and 46 to keep switching and thus to keep the circuit in a continuous mode. Furthermore, in view of this topology, resistors 40 and 42 are also relatively small and inexpensive, namely, ½ to 1 watt and 24K to 30KΩ.

So as to further increase efficiencies, diodes 102 are provided and are connected across the base to collector of each transistor 44 and 46. These diode are preferably of the fast recovery type and exhibit a low instantaneous forward voltage drop. Diodes 102 prevent over saturation of the transistors and provide for more efficient switching and, further, decrease co-conduction by reducing fall times of the transistors. In essence, diodes 102 tend to divert the current being provided to the bases of transistors 44 and 46 to their respective collector after transistor saturation has occurred thus preventing excess modulation of the energy layer in the transistors and thus decreasing fall time. Thus, the transistors are more capable of quickly switching off and exhibit a more perfect square wave operation in collector to emitter current flow. This is especially beneficial during no load conditions because most ballast biasing schemes are of the fixed drive type and suffer from increased storage and fall times due to an excess of base current which causes increased switching losses.

Figure 2:
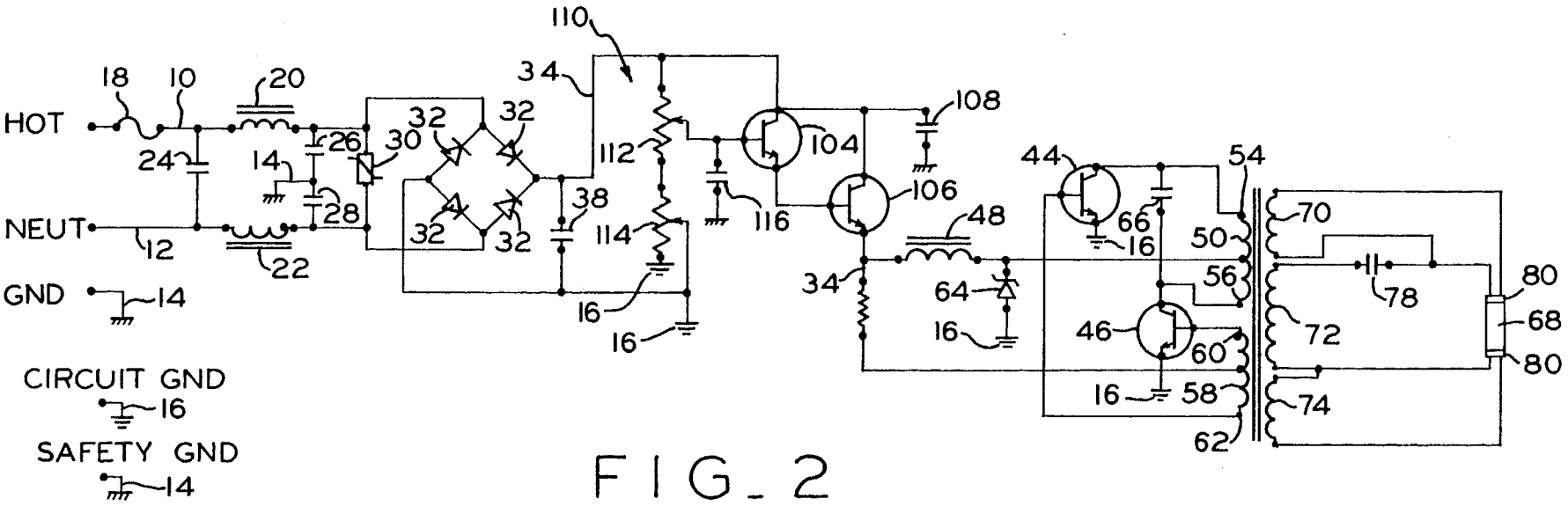

Referring now to FIG. 2, there is shown a gas discharge lamp driving circuit substantially similar to that of FIG. 1 except that the biasing circuit and the diode 102 across the base to collector of each transistor have been omitted. The circuit of FIG. 2 is further different in that it provides for dimming of the gas discharge lamps 68. This is accomplished by selectively varying the voltage of the unfiltered rectified direct current signal supplied by the full wave bridge 31 to the oscillating circuit through line 34. By selectively varying the voltage of the modulated signal, reduced voltages occur at the transformer and thus the lumens output by lamps 68 can also be selectively varied. In the preferred embodiment as shown, the modulated signal voltage is selectively varied with a pair of transistors 104 and 106 connected together as a Darlington pair. In essence, the collectors of both transistors 104 and 106 are connected to safety ground through capacitor 108. The emitter of transistor 104 is connected to the base of transistor 106, the emitter of transistor 106 is connected to line 34 for providing the selectively varying modulated signal voltage and the base of transistor 104 is connected to a selectively variable voltage divider network generally indicated by 110. Voltage divider network 110 includes a variable resistor or pot 112 and variable resistor 114 connected in series with one another between circuit ground and line 34. Variable resistor 114 is connected and adapted for selectively varying the resistance thereof to circuit ground whereas variable resistor 112 is connected and adapted for varying the resistance and, thus, the voltage output to the base of transistor 104. A 0.0033 μF capacitor 116 is connected between the base of transistor 104 and safety ground and is provided for EMI filtering. As can be appreciated, by merely dialing the variable resistor 112, the rectified direct current signal voltage is varied on line 34 and thereby controlling the total lumens output of lamps 68. Additionally, by dialing variable resistor 114, the overall range of voltage flow capable by dialing variable resistor 112 is itself varied.

It is noted that transistors 104 and 106 connected together as a Darlington pair provide for a generally large range of current flow variability. However, a single transistor could be used for accomplishing the same function such as by eliminating transistor 106 and merely connecting the emitter of transistor 104 to line 34. Such a circuit would function in substantially the same way except that the overall range of current variability and, thus, dimming would be diminished, and most likely increasing the cost of the circuit.

While the invention has been described as having specific embodiments, it will be understood that it is capable of further modification. This application is, therefore, intended to cover any variations, uses, or adaptations of the invention following the general principles thereof and including such departures from the present disclosure as come within known or customary practice in the art to which this invention pertains and fall within the limits of the appended claims.

What is claimed is:

1. A circuit for driving a gas discharge lamp comprising:

first and second conductors for connection to an alternating power source signal at a first frequency;

oscillator means coupled to said first and second conductors for producing a signal at a second higher frequency than said first frequency on said power source signal and having an output for driving the gas discharge lamp;

first inductor means between first conductor and said oscillator means for effectively allowing current flow at said first frequency while inhibiting current flow at said second frequency;

second inductor means being physically and magnetically separate from said first inductor means and between said second conductor and said oscillator means for effectively allowing current flow at said first frequency while inhibiting current flow at said second frequency.

2. The circuit of claim 1 further comprising first capacitance means connected between said first and second conductors for shorting differential high frequency signals.

3. The circuit of claim 1 further comprising a second capacitance means connected between said first conductor and a ground and a third capacitance means connected between said second conductor and ground for canceling common high frequency signals.

4. The circuit of claim 1 further comprising:

full wave rectifier means between said first and second inductor means and said oscillator means for supplying a substantially unfiltered rectified direct current signal to said oscillator means; and, a transformer having a primary winding coupled to said oscillator means and a secondary winding for driving said gas discharge lamp.

5. The circuit of claim 1 wherein each of said first and second inductor means include physically separated slug cores.

6. The circuit of claim 1 further comprising:

a first capacitance means connected between said first and second conductors for shorting differential high frequency signals;

a second capacitance means connected between said first conductor and a ground and a third capacitance means connected between said second conductor and ground for shorting common high frequency signals;

wherein each of said first and second inductor means include physically separated slug cores;

full wave rectifier means between said first and second inductor means and said oscillator means for supplying a substantially unfiltered rectified direct current signal to said oscillator means; and, a transformer having a primary winding coupled to said oscillator means and a secondary winding for driving said gas discharge lamp.

7. A circuit for driving a gas discharge lamp comprising:

full wave rectifier means for connecting to an alternating power source signal and supplying a substantially unfiltered rectified direct current signal at a first frequency;

a transformer having a primary winding with first, second and third tap points, said second tap being intermediate said first and second taps and coupled to said full wave rectifier means, said transformer further having a secondary winding for driving said discharge lamp;

a first transistor having its collector connected to said first tap and a second transistor having its collector connected to said third tap, each of said transistors having an emitter connected to ground and a base coupled to said full wave rectifier means whereby said transistors oscillate in a push/pull relation when said rectified direct current signal is applied thereto; and, a diode having low instantaneous forward voltage drop connected directly between the base and collector of each of said transistors for directing current from respective base to collectors to prevent excessive saturation of the transistors.

8. The circuit of claim 7 further comprising biasing means for supplying a small direct current to said transistors for retaining said transistors in a switching mode during substantially zero voltage valleys of said rectified direct current signal.

9. The circuit of claim 8 further comprising:

first and second conductors for connection to said electrical power source signal;

first inductor means between said first conductor and said full wave rectifier means for effectively allowing current flow at said first frequency while inhibiting current flow at said second frequency; and, second inductor means between said second conductor and said full wave rectifier means for effectively allowing current flow at said first frequency while inhibiting current flow at said second frequency.

10. The circuit of claim 9 further comprising means coupled between said full wave rectifier means and said oscillating means for selectively varying the current of said rectified direct current signal supplied to said oscillating means and thereby selectively dimming said discharge lamp.

11. The circuit of claim 7 further comprising:

first and second conductors for connection to said electrical power source signal;

first inductor means between said first conductor and said full wave rectifier means for effectively allowing current flow at said first frequency while inhibiting current flow at said second frequency; and, second inductor means between said second conductor and said full wave rectifier means for effectively allowing current flow at said first frequency while inhibiting current flow at said second frequency.

12. The circuit of claim 7 further comprising means coupled between said full wave rectifier means and said oscillating means for selectively varying the voltage of said rectified direct current signal supplied to said oscillating means and thereby selectively dimming said discharge lamp.

13. The circuit of claim 1, further comprising:

full wave rectifier means connected to said first and second conductors for supplying a substantially unfiltered rectified direct current signal to said oscillator means; and, biasing means for supplying a small direct current to said oscillator means for retaining said oscillator means in an oscillating mode during substantially zero voltage valleys of said rectified direct current signal.

14. The circuit of claim 1, further comprising:

full wave rectifier means connected to said first and second conductors for supplying a substantially unfiltered rectified direct current signal to said oscillator means; and, means coupled between said full wave rectifier means, and said oscillator means for selectively varying the voltage of said rectified direct current signal supplied to said oscillator means and thereby selectively dimming said discharge lamp.

15. The circuit of claim 7, further comprising biasing means for supplying a small direct current to said first and second transistors for retaining said transistors in an oscillating mode during substantially zero voltage valleys of said rectified direct current signal.

16. The circuit of claim 7, further comprising means coupled between said full wave rectifier means and said transistors for selectively varying the voltage of said rectified direct current signal supplied to said transistors and thereby selectively dimming said discharge lamp.

* * * * *